United States Patent [19]

Heidmann

[11] 4,406,101

[45] Sep. 27, 1983

[54] PARTITION WIREWAY WITH FLEXIBLE SIDES

[75] Inventor: Charles Heidmann, Strasbourg, France

[73] Assignee: Steelcase Inc., Grand Rapids, Mich.

[21] Appl. No.: 187,834

[22] Filed: Sep. 16, 1980

[51] Int. Cl.[3] ..... E04B 5/48; H02G 3/26

[52] U.S. Cl. ..... 52/220; 52/290; 52/242; 174/48; 339/23

[58] Field of Search ..... 52/220, 221, 240, 242, 52/241, 290, 288, 239, 287; 339/23; 174/48

[56] References Cited

U.S. PATENT DOCUMENTS

| | | | |
|---|---|---|---|
| 1,998,234 | 4/1935 | Grimes | 52/242 X |
| 3,844,079 | 10/1974 | Karrip | 52/221 |
| 3,862,524 | 1/1975 | McCrackin | 52/239 X |
| 3,983,670 | 10/1976 | Lightfoot | 52/290 X |
| 4,094,561 | 6/1978 | Wolff et al. | 339/23 X |
| 4,133,153 | 1/1979 | Hage | 52/242 X |
| 4,231,630 | 11/1980 | Propst et al. | 52/221 X |
| 4,255,610 | 3/1981 | Textoris | 174/48 |
| 4,257,203 | 3/1981 | Propst et al. | 52/221 |
| 4,277,123 | 7/1981 | Haworth et al. | 174/48 X |

FOREIGN PATENT DOCUMENTS

| | | | |
|---|---|---|---|
| 2415768 | 10/1975 | Fed. Rep. of Germany | 174/48 |
| 437457 | 11/1967 | Switzerland | 174/48 |
| 135210 | 1/1961 | U.S.S.R. | 174/48 |

*Primary Examiner*—J. Karl Bell

*Attorney, Agent, or Firm*—Price, Heneveld, Huizenga & Cooper

[57] ABSTRACT

A movable room divider or partition is provided with a raceway for communication cables, and other casual wiring. The raceway comprises a U-shaped channel connected with the partition and extending along and beneath the base of the partition. The channel has a rigid web for supporting the cables, and a pair of upstanding flanges with free edges disposed adjacent the partition base to enclose the raceway. At least one of the flanges is resiliently flexible to permit localized, elastic deformation of the flange for inserting and withdrawing the cables from the raceway.

2 Claims, 4 Drawing Figures

PARTITION WIREWAY WITH FLEXIBLE SIDES

BACKGROUND OF THE INVENTION

The present invention relates to movable room divider panels or partitions, and in particular to a wireway therefor.

Heretofore, partitions have been provided with wiring raceways which extend along the base of the partition panel. These partition wireways are designed to house both power wires, such as 110 VAC lines, for lighting, typewriters, and other office appliances, as well as communication lines and other casual wiring. A removable cover is provided to access the wireway, and the electrical cables are generally retained in a separate rigid enclosure within the wireway to positively segregate the power cables from the other wires.

The above partition wireway arrangements provide limited storage space for communication cables and other casual wiring. Also, such partitions are difficult to wire and cannot be easily modified to accept additional casual wires, as the covers of the panel wireways must be removed and replaced to accomplish insertion or withdrawal of wiring from the raceway. The removal and replacement of the wireway covers is especially difficult and time consuming when furniture and other heavy objects have been placed directly in front of the covers, as is normally the case in partitioned areas.

SUMMARY OF THE INVENTION

One aspect of the present invention is to provide a partition wireway for communication cables and the like, comprising a U-shaped channel connected with the partition and extending along and beneath the base of the panel. The U-shaped channel includes a rigid web for supporting the cables thereon, and a pair of upstanding flanges with free edges disposed adjacent the bottom of the partition base to substantially enclose the raceway. At least one of the flanges is resiliently flexible, with sufficient stiffness to normally maintain the U-shape of the channel and thereby retain and conceal the cables therein and sufficient flexability to permit localized, manual, elastic deformation along the flange free edge for inserting and withdrawing the cables from the raceway. The channel preferably includes at least two spacers connected to the channel at the centerline of the channel web, with an upper end thereof attached to a support to suspend the raceway therefrom.

The principal objects of the present invention are to provide additional storage space under the base of the partition for communication cables and other casual wiring. At least one of the wireway sides is flexible so that the wires can be easily inserted and withdrawn from the raceway, without removing or replacing a raceway cover. The flexible side of the partition wireway permits an installer to quickly and easily arrange casual wiring in the raceways, even when furniture, or other large objects are positioned immediately adjacent the partitions. The partition wireway is quite efficient in use, economical to manufacture, capable of a long operating life, and particularly well adapted for the proposed use.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
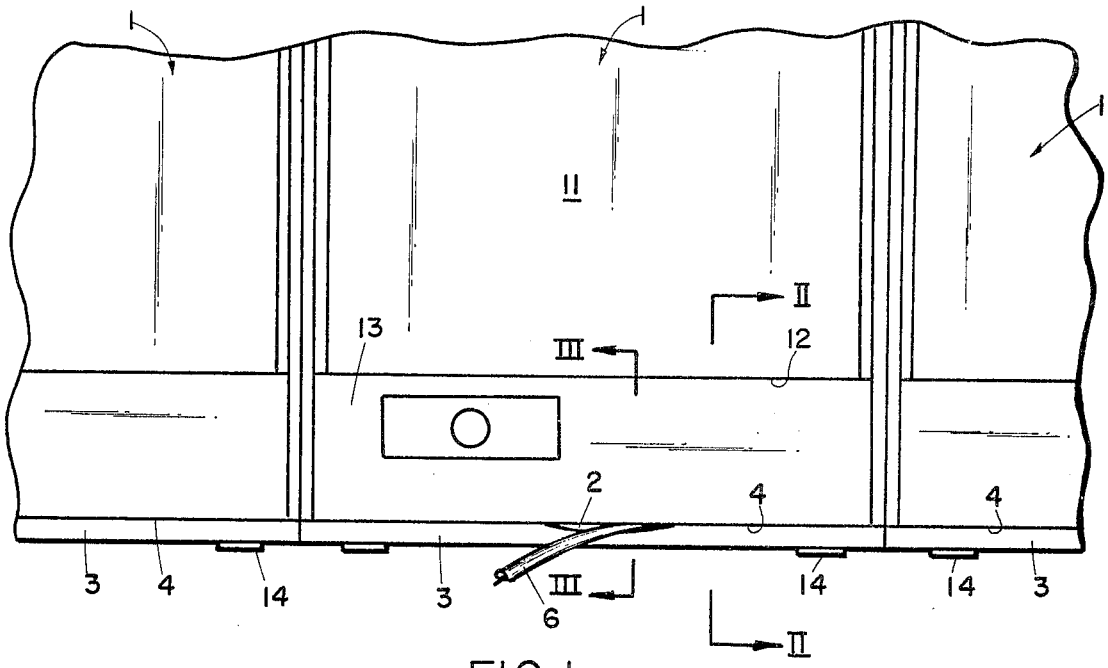
FIG. 1 is a fragmentary, front elevational view of three interconnected partitions, each having a wireway embodying the present invention, and being shown with a communication cable being inserted into the center partition wireway.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

Figure 2:
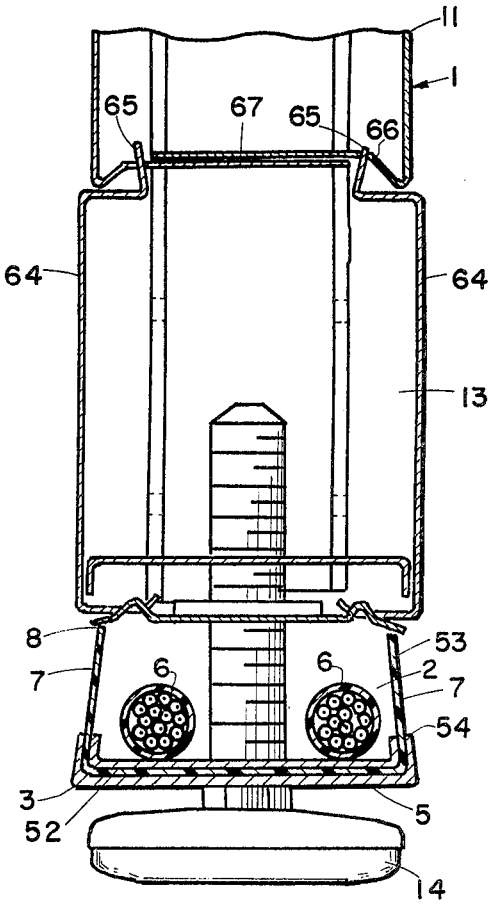
FIG. 2 is a fragmentary, vertical cross-sectional view of the partition wireway, taken along the line II—II, FIG. 1.

The reference numeral 1 generally designates a partition having a wiring raceway 2 for communication cables, and the like, which embodies the present invention. Raceway 2 comprises a U-shaped channel 3 (FIG. 2) connected with partition 1 and extending along and beneath the base 4 of the partition. Channel 3 has a rigid web 5 for supporting cable 6 and a pair of upstanding flanges 7 with free edges 8 disposed adjacent the partition base to enclose the raceway. At least one of the flanges 7 is resiliently flexible to permit localized, elastic deformation of the flange for inserting and withdrawing the cable 6 from the raceway.

As best illustrated in FIG. 1, each of the partitions 1 is a movable room divider having a conventional construction. In this example, the partitions 1 include a divider panel 11 having the bottom edge 12 with an electrical power wireway 13 mounted thereunder. A pair of adjustable feet 14 are attached to the panel lower edge 12 adjacent each end thereof and are adapted to abut the floor or ground and support the partition thereon in an upright orientation.

Figure 4:
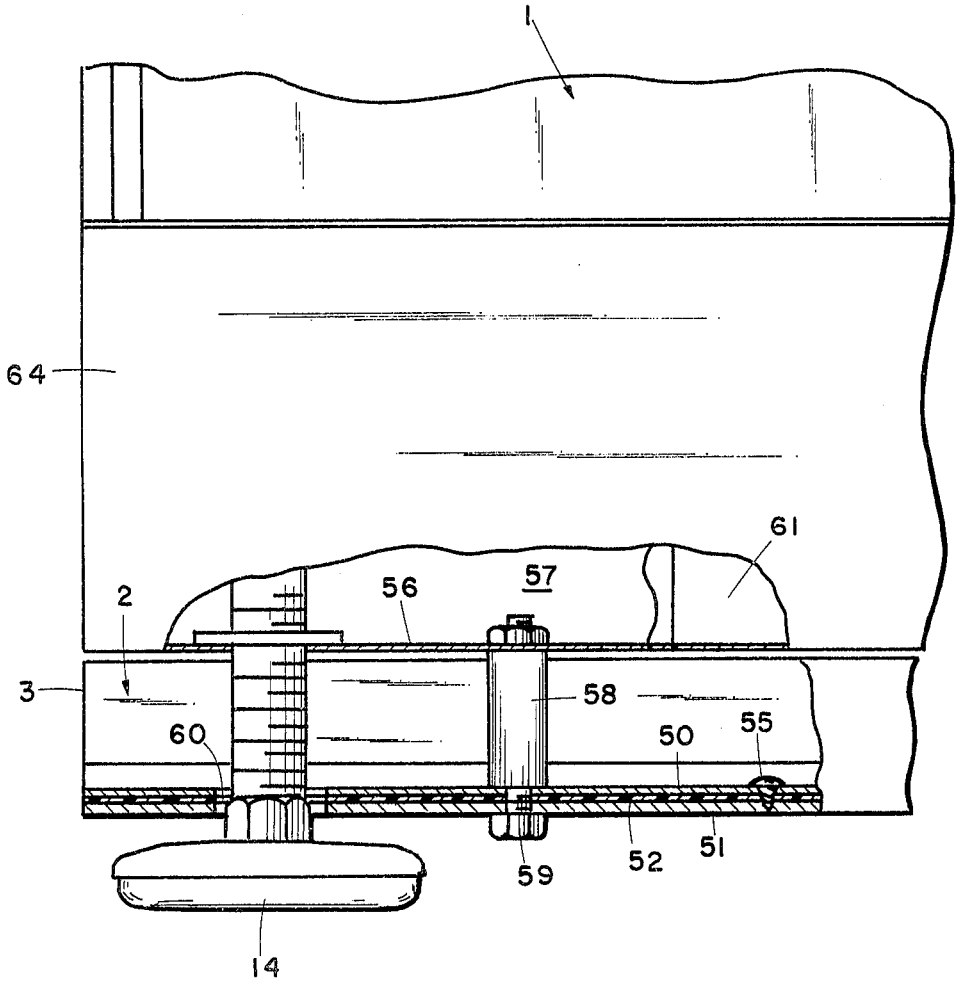
FIG. 4 is a fragmentary, side elevational view of the partition wireway with a portion thereof broken away to reveal internal construction.

Raceway 2 is suspended from the base 4 of partition 1 along the centerline of the channel web 5, thereby forming two separate receptacles for the communication cable 6, and permitting insertion and withdrawal of the cables from both sides of the raceway. Raceway 2 comprises first and second elongate, rigid sheet metal channels 50 and 51, which are shaped to fit into one another to form the rigid web portion 5 of channel 3. A sheet 52 of resilient material has a center portion thereof sandwiched between channels 50 and 51, with side edge portions 53 extending from inbetween the upturned edges 54 of the channels to form the flanges 7 of channel 3. The flexibility or durometer of sheet 52 is substantially constant throughout the same. Fasteners 55 (FIG. 4) extend through the web of the channels 50 and 51, as well as sheet 52, to retain the assembly together. Channel 3 is suspended from the base 56 of power wireway 57 by sleeve-shaped spacers 58 through which fasteners 59 are received. Apertures 60 are provided through the channels 50–51 and flexible sheet 52 at the ends of raceway 2 through which partition feet 14 extend. Electrical connectors 61 are mounted on the upper surface of base plate 56.

Channel 3 is connected with partition 1, and extends along and beneath the bse 4 of partition 1. The web 5 of channel 3 is rigid for supporting cables 6 thereon, and at least one of flanges 7 is resiliently flexible, with sufficient stiffness to normally maintain the U-shape of the channel, and thereby retain and conceal cables 6 therein, and sufficient flexibility to permit localized, manual elastic deformation along the free edge of the flexible flange for inserting and withdrawing the cables from the raceway.

In operation, the raceway 2 extends along the base of the power wireway 57 in which power lines (not shown) are housed. Covers 64 are provided on both sides of partition 1 to enclose power wireway 57, and include upper tabs 65 which are inserted into mating apertures 66 in the bottom 67 of partition panel 1. The lower edge of cover 64 includes at least two inwardly inclined flanges 68 with apertues 69 therein which mate with an upwardly protruding clip 70 to form a snap lock which holds the bottom edge of the cover in place. Clips 70 also include an outwardly inclined portion 71, which when pushed inwardly by the installer, releases the snap lock, such that the cover 64 can be removed.

Figure 3:
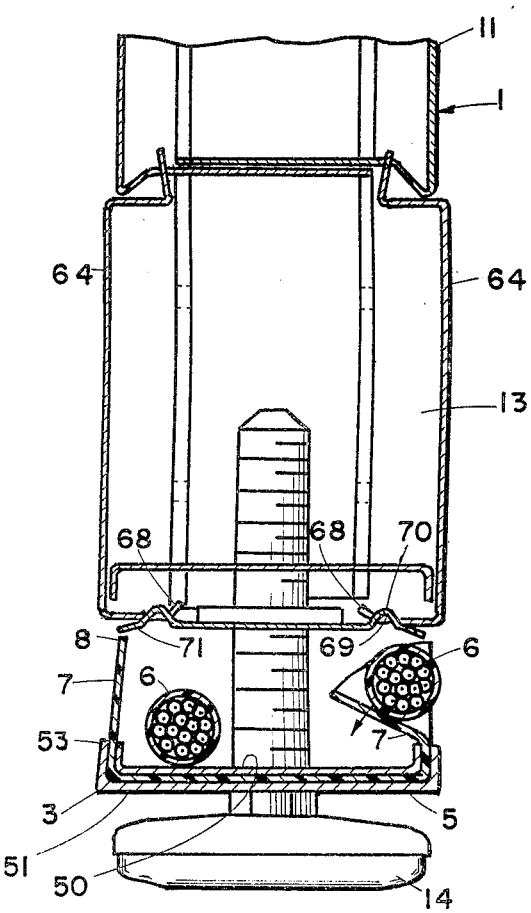
FIG. 3 is a fragmentary, vertical cross-sectional view of the partition wireway, taken along the line III—III, FIG. 1.

To insert a cable 6 into the raceway 2, the installer simply pushes cable 6 inwardly against the flange 7, thereby deforming the flange downwardly in the manner illustrated in FIG. 3. Flange 7 tends to pivot about the upper edges 54 of channels 50 and 51. After the cable 6 has been fully inserted into the raceway 2, the free edge 8 of the channel flanges clears the outside edge of the cable, and the resiliency of the flange returns the same to its upright position, so as to retain and conceal the cables in the raceway.

The raceway 2 provides additional storage for communication cables, and other casual wiring, so as to provide a safe, attractive partition arrangement. The flexible channel flanges permit the installer to easily remove and replace wires from the channel without removal of the power wireway cover 64. Hence, even when furniture or other large objects are positioned directly adjacent a partition, cable 6 can be inserted into the raceway 2 without requiring the object to be moved.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a partition having a raised base with depending spaced apart feet supporting said partition, the improvement of a raceway for communication cables and the like, comprising:

a U-shaped channel connected with said partition, and extending along and beneath said partiton base; said U-shaped channel having a rigid web for supporting the cables thereon, and a pair of upstanding flanges; said flanges extending upwardly from opposite sides of said web, and having free, upper edges positioned adjacent to a bottom surface of said partition base to define opposite sides of said raceway and substantially enclose the same; at least one of said flanges being resiliently flexible, with sufficient stiffness to normally maintain the U-shape of said channel and thereby retain and conceal the cables therein, and sufficient flexibility to permit localized, manual, elastic deformation along said one flange free edge for inserting and withdrawing the cables from said raceway;

said channel is connected with said partition by means for suspending said channel from said panel base;

said suspending means is connected with said channel web along the longitudinal centerline thereof;

said other one of said channel flanges is resiliently flexible for inserting and withdrawing the cables from both sides of said partition; and said channel comprises first and second, elongate, rigid, U-shaped supports, which are shaped to fit into one another to form said rigid web, and a sheet of resiliently flexible material having a center portion thereof sandwiched between said first and second supports with side edge portions extending from inbetween the edges of said supports to form said flanges.

2. A partition as set forth in claim 1, wherein:

said channel is connected with said partition by spacers extending between the upper one of said supports and said partition base, with fasteners extending through said upper support, said spacers, and said partition base and interconnecting the same.

* * * * *